United States Patent [19]

Binnersley

[11] 4,329,750

[45] May 18, 1982

[54] METHOD FOR APPLYING FINISH TO A YARN

[75] Inventor: Edwin K. Binnersley, Wilmington, Del.

[73] Assignee: E. I. Du Pont de Nemours and Company, Wilmington, Del.

[21] Appl. No.: 187,172

[22] Filed: Sep. 15, 1980

[51] Int. Cl.[3] ..... D06B 1/08

[52] U.S. Cl. ..... 8/151.2; 68/200; 118/420; 427/434.6

[58] Field of Search ..... 8/151.2; 68/181 R, 200, 68/205 R; 427/434.6; 118/410, 420; 65/10.1, 11.1

[56] References Cited

U.S. PATENT DOCUMENTS

| | | | |
|---|---|---|---|
| 1,934,796 | 11/1933 | Friederich | 118/401 |
| 2,080,193 | 5/1937 | Bakker | 570/295 |
| 2,675,690 | 4/1954 | Griset, Jr. | 68/205 R X |
| 3,244,142 | 4/1966 | Walker | 68/200 X |
| 3,336,901 | 8/1967 | Dauchert | 118/411 |
| 3,468,284 | 9/1969 | Chaban | 118/44 |
| 3,754,530 | 8/1973 | Pierce | 118/420 |
| 3,766,886 | 10/1973 | Perberschlager | 118/420 |
| 3,893,412 | 7/1975 | Louch et al. | 118/420 |
| 3,922,144 | 11/1975 | Zöllner | 8/145.2 |
| 4,096,611 | 6/1978 | Heyner | 28/220 |
| 4,247,505 | 1/1981 | Jackson | 264/176 F |
| 4,253,416 | 3/1981 | Williams, Jr. | 118/401 |
| 4,255,472 | 3/1981 | Williams, Jr. | 427/445 |
| 4,255,473 | 3/1981 | Williams, Jr. | 427/445 |

FOREIGN PATENT DOCUMENTS

| | | | |
|---|---|---|---|
| 374507 | 4/1923 | Fed. Rep. of Germany | 8/151.2 |
| 1478480 | 6/1977 | United Kingdom . | |

OTHER PUBLICATIONS

Research Disclosure, Feb. 1978.

Spin Finish Metering Pumps, Slack & Parr Ltd.

Textile Research Journal, "Spin Finishes Explained", W. Postman, Jul. 1980.

*Fiber Producer,* Aug. 1980, (cover and p. 3).

*Fiber Producer,* Oct., 1980, "Metered Finish as Applied to Melt Spun Fibers," Charles S. W. King.

*Primary Examiner*—Philip R. Coe

[57] ABSTRACT

A yarn finish applicator in which finish is metered to a slot running from top to bottom of the applicator. The configuration of the body of the applicator and its slot provides an edge at the exit end of the applicator and a slot that is slightly wider at the location at which finish is metered to the slot than at exit of the slot. Two rods are located just below the exit edge of the applicator to collect and drain to a receiver any drops of excess finish which form at the exit edge of the applicator when the threadline is not running.

1 Claim, 6 Drawing Figures

METHOD FOR APPLYING FINISH TO A YARN

BACKGROUND OF THE INVENTION

This invention relates to method for applying liquid finish to a moving continuous filament yarn.

It is well known in the art that acceptable processing of synthetic continuous filament yarn requires the application of textile-treating compositions such as lubricants and antistatic agents and the like. These applications must be accomplished in a manner to apply a uniform coating to the filaments with a minimum loss of the composition. One method for such application uses an applicator in which yarn contacts the bottom of a groove provided with a orifice through which is metered the desired quantity of treating composition. The present invention improves such application by providing a groove-type applicator which is virtually dripless and capable of applying liquid finishes very uniformly to the filaments of a yarn bundle passing through the applicator. In addition, means are provided to collect and drain to a receiver any drops of excess finish which form at the exit edge of the applicator when the threadline is not running.

SUMMARY OF THE INVENTION

In accordance with the present invention, there is provided a yarn finish applicator that includes a body member that has top, opposed side, front and back surfaces. A slot with bottom and side walls is formed in the front surface running from top to bottom of the body member. The slot has bottom and side walls with a passage connecting the back surface of the body member through which is metered the desired quantity of liquid finish. The lower portion of the front and back surfaces of the body member are angled downwardly toward each other and in conjunction with the opposed side surfaces which taper downwardly toward each other form an edge at the bottom wall of the slot. The side walls of the slot taper inwardly toward the bottom wall while tapering toward each other from top to bottom. This unique slot configuration not only facilitates placing the moving yarn line in the applicator slot but also prevents the finish from migrating by surface-tension-induced spreading away from the yarn path. A pair of parallel rods are located so that one end of the rods is in close proximity to the back surface of the body at its bottom edge. The rods lead downwardly away from the edge into a receiver to return droplets of excess finish to the receiver which form when the threadline is not running in the slot.

The method includes the steps of maintaining the yarn contact with the bottom of the slot while splaying the filaments from about 60 percent to about 90 percent of the width of the slot at the location where finish is introduced into the slot then confining the filaments, so that at the applicator's exit, up to about 20 percent of the filaments are forced to form additional layers over the filaments in contact with the applicator. The departing filaments are led tangentially from the exit end of the bottom wall of the slot.

DETAILED DESCRIPTION OF THE PREFERRED EMBODIMENT

Figure 1:
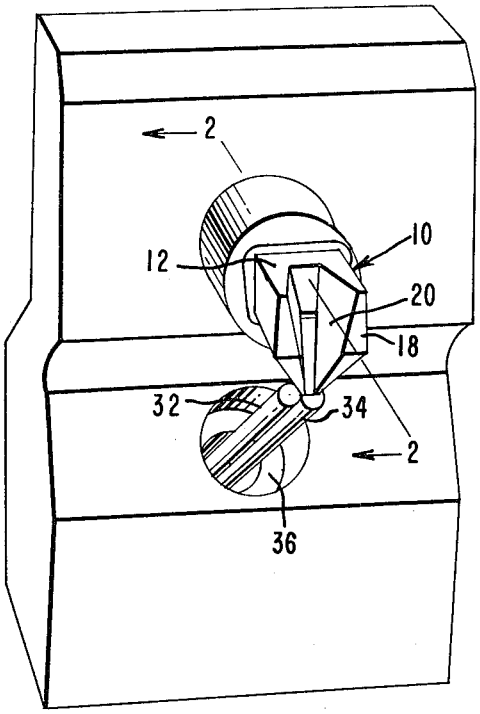
FIG. 1 is a perspective view of the finish applicator of this invention.
Figure 2:
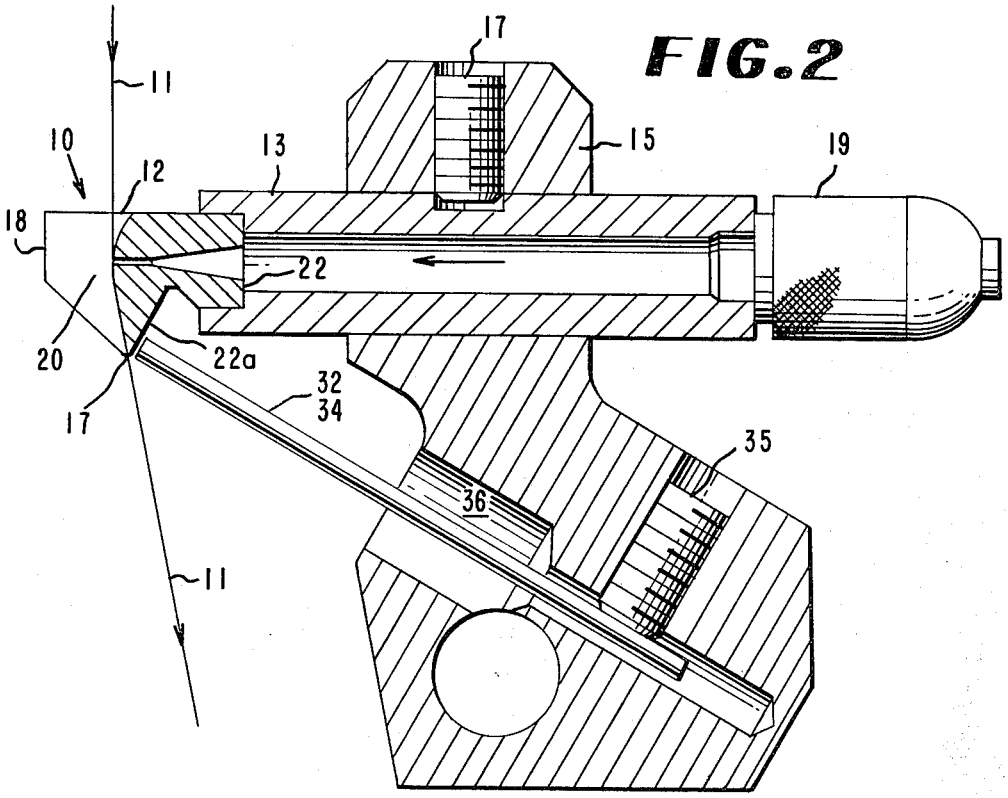
FIG. 2 is a cross-sectional view of FIG. 1 taken along line 2—2.
Figure 3:
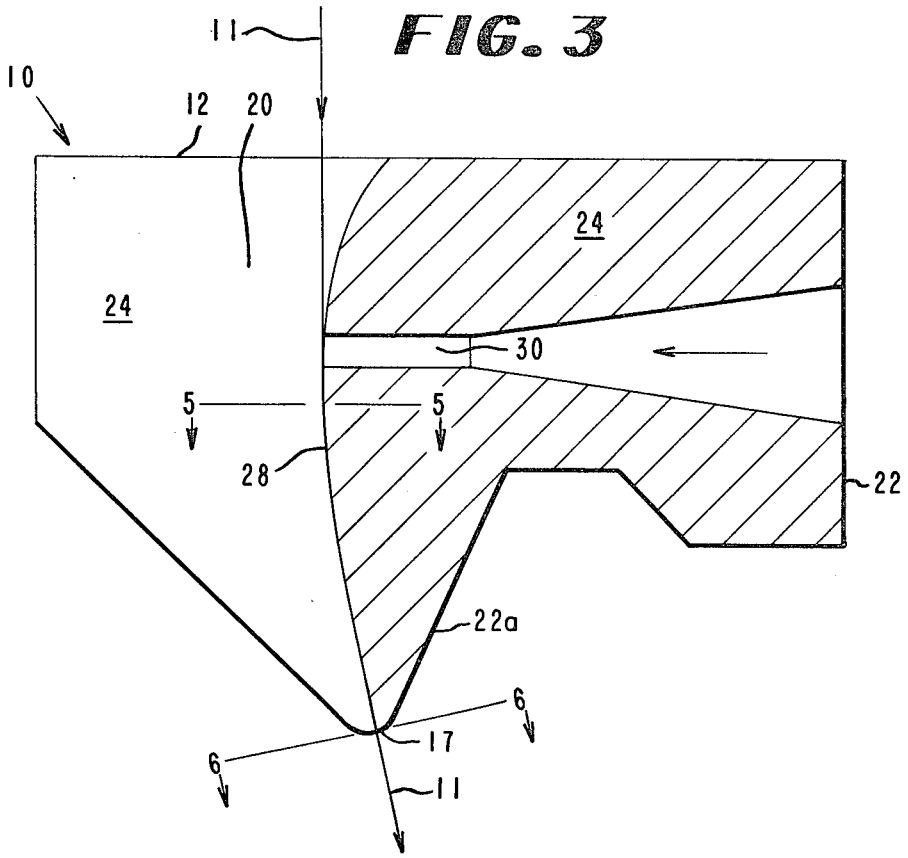
FIG. 3 is an enlarged view of the cross-sectioned applicator body member as seen in FIG. 2.
Figure 4:
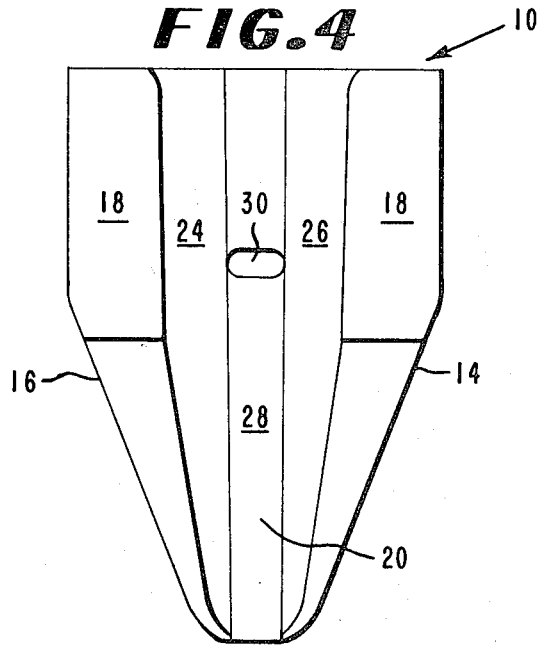
FIG. 4 is an enlarged front view of the applicator body member.

Referring to the drawings, the embodiment chosen for purposes of illustration includes an applicator body member 10, a pipe 13, and a bracket 15. The pipe 13 is held in a bore through the upper portion of bracket 15 by means of a set screw 17. The pipe is connected to a source of liquid finish (not shown) by means of fitting 19. The applicator body member 10 which is cemented into the outlet end of pipe 13 has a top surface 12, opposed side surfaces 14, 16 and a front surface 18 in which is formed a slot 20 and back surface 22 which terminates in a lower portion **22*a*. The slot 20 runs from the top surface 12 to the bottom of the applicator body member and is defined by side walls 24, 26 and bottom wall 28. A passage 30 connects the back surface 22 of the body member with the bottom wall 28 of the slot for supplying a liquid finish to the slot. The yarn 11 runs from top to bottom of the applicator as indicated by the arrow. A pair of parallel rods 32, 34, are located in close proximity to the lower portion 22*a* of the back surface of the body member and lead downwardly to a receiver 36 in bracket 15 for collecting excess finish which accumulates when the threadline is not running. The rods 32, 34 are held in position in the bracket by set screw 35. The body member 10 features a sharp wedge exit edge 17 formed by the front and back surfaces 18, 22*a* respectively, being angled toward each other and defined on the sides by tapering side surfaces 14, 16. The ends of rods 32, 34 are arranged so that they are located slightly above the edge 17**.

Figure 5:
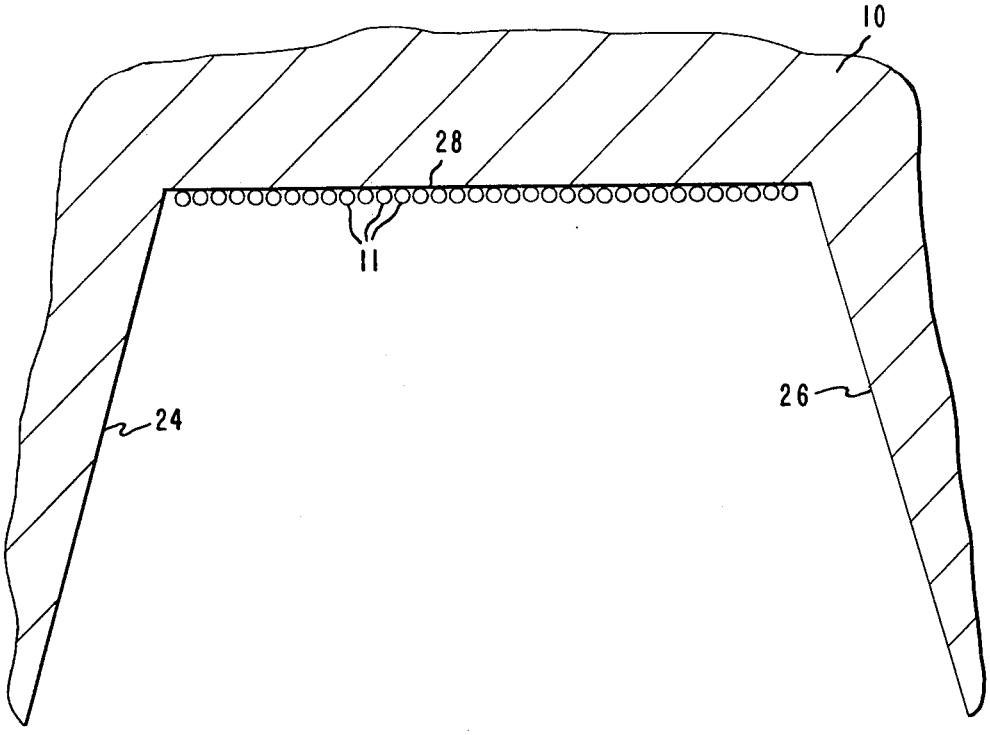
FIGS. 5 and 6 are sectioned views of the slot in the applicator body member taken along lines 5—5 and 6—6 respectively showing yarn positioned in the slot at those locations.
Figure 6:
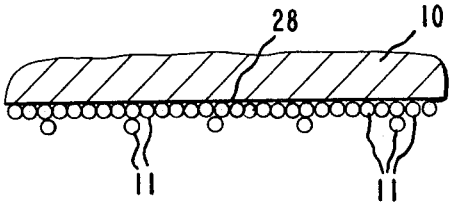

As best seen in FIGS. 3–6 the slot 20 is defined by side walls 24, 26 and a bottom wall 28. The side walls 24, 26 taper inwardly toward each other as they approach bottom wall 28 and also taper toward each other as they progress from top to bottom of the applicator body member. The configuration of the slot 20 is a critical feature of the invention. More particularly, the slot is tapered where the filament bundle of the moving yarn line 11 contacts the bottom wall 28. Finishing liquid is applied to the yarn at the initial point of contact with the bottom wall of the slot, i.e., at passage 30. As seen in FIG. 5 the tapered slot 20 at the initial contact point is slightly larger than the sum of the individual filament diameters so that there is a small space between the individual filaments which permits finish liquid to contact each filament. The filaments are splayed as a single layer from about 60 to about 90 percent of the orifice width. At the exit of the slot 20 the bottom wall has a width which is preferably slightly less than the sum of the diameters of the individual filaments. In other words, the slot 20 is progressively narrower in the direction of travel of the yarn thus providing a fully wiped bottom surface at its exit as shown in FIG. 6 where the sidewalls taper away to edge 17, and the slot has confined the bundle to force formation of additional layers of filaments.

In operation, the yarn picks up finish at the point of initial yarn contact with the bottom wall of the slot at the location where finish is introduced through passage 30 and carries it forward along the tapered slot 20 and exits the slot tangentially with the bottom surface 28 with no separation between the bottom surface 28 and the threadline. The combination of the fully wiped bottom surface and the tangential exit of the yarn from the slot permits all of the finish to leave the slot with the yarn giving a uniform finish application on the yarn without the formation of drops at the exit end of the applicator. However if for some reason the threadline is not running in the slot while the finish is metered through passage 30 then the finish will run down the slot, form droplets at edge 17 and the droplets will be conveyed by rods 32, 34 along their under-surface by capillary action and gravity flow from the edge 17 to the receiver 36.

The applicator of this invention may be used to apply liquid materials which are not harmful to the yarn or the applicating system. Examples of liquids which may be applied are solutions, dyes, dispersions, or emulsions of conventional treating agents such as lubricants, antistatic agents, binders, softeners and the like. The liquid may be applied to such man-made continuous filament yarns as, for example, polyamides, polyesters, polyacrylics, spandex, rayon, and celullose acetate.

I claim:

1. In a method for applying finish to a continous filament yarn passing through a slot in an applicator wherein finish is supplied to said slot through an orifice in the bottom wall of the slot, the improvement comprising: maintaining yarn contact with the bottom wall of the slot while splaying the filaments as a single layer from about 50 to about 90 percent of the width of said slot at said orifice then confining the filaments to force the formation of additional layers of filaments near the exit of the slot, and leading the filaments tangentially from the exit edge of the bottom wall of the slot.

* * * * *

UNITED STATES PATENT OFFICE

CERTIFICATE OF CORRECTION

PATENT NO. : 4,329,750

DATED : May 18, 1982

INVENTOR(S) : Edwin K. Binnersley

It is certified that error appears in the above-identified patent and that said Letters Patent are hereby corrected as shown below:

Column 4, line 8, change "continous" to read -- continuous --;

Column 4, line 14, change "50" to read -- 60 --.

Signed and Sealed this

*Twentieth* Day of *July 1982*

[SEAL]

*Attest:*

GERALD J. MOSSINGHOFF

*Attesting Officer*

*Commissioner of Patents and Trademarks*